US006283072B1

(12) United States Patent
Lavy et al.

(10) Patent No.: US 6,283,072 B1
(45) Date of Patent: Sep. 4, 2001

(54) METHOD FOR CONTROLLING OIL FLOW RATE IN A TWO-STROKE ENGINE WITH SEPARATE LUBRICATION AND RELATED ENGINE

(75) Inventors: Jacques Lavy, Guyancourt (FR); Yoichi Ishibashi, Tokorozawa (JP); Philippe Girard, Montigny le Bretonneux (FR)

(73) Assignee: Elf Antar France, Paris la Defense ( * ) Notice: Subject to any disclaimer, the term of this patent is extended or adjusted under 35 U.S.C. 154(b) by 0 days.

(21) Appl. No.: 09/341,949

(22) PCT Filed: Nov. 20, 1998

(86) PCT No.: PCT/FR98/02488

§ 371 Date: Oct. 13, 1999

§ 102(e) Date: Oct. 13, 1999

(87) PCT Pub. No.: WO99/27236

PCT Pub. Date: Jun. 3, 1999

(30) Foreign Application Priority Data

Nov. 21, 1997 (FR) ..... 97 14752

(51) Int. Cl.[7] ..... F02B 33/04

(52) U.S. Cl. ..... 123/73 AD; 123/196 R

(58) Field of Search ..... 123/73 AD, 196 R

(56) References Cited

U.S. PATENT DOCUMENTS 5,313,849 * 5/1994 Miyata et al. ..... 73/866.5
5,355,851 * 10/1994 Kamiya ..... 123/196 R

FOREIGN PATENT DOCUMENTS

508486A1 10/1992 (EP) .
2127694 * 10/1972 (FR) .

* cited by examiner

*Primary Examiner*—Tony M. Argenbright
*Assistant Examiner*—Katrina B. Harris
(74) *Attorney, Agent, or Firm*—Antonelli, Terry, Stout & Kraus, LLP

(57) ABSTRACT

This invention relates to a process for monitoring the flow rate of oil that is injected into a two-stroke internal combustion engine where the oil is injected independently of the gasoline. According to the invention, the oil flow rate is based on a temperature that represents the heat load of the engine. More specifically, this temperature can be that of an element that constitutes the engine, such as that of the spark plug gasket.

31 Claims, 2 Drawing Sheets

METHOD FOR CONTROLLING OIL FLOW RATE IN A TWO-STROKE ENGINE WITH SEPARATE LUBRICATION AND RELATED ENGINE

BACKGROUND OF THE INVENTION

1. Field of the Invention

This invention relates to the field of two-stroke internal combustion engines in which the oil is injected independently of the gasoline. These engines are also called engines with separate lubrication.

More specifically, the invention describes the monitoring of the flow rate, or metering, of the oil that is injected into this type of engine.

2. Description of the Prior Art

The known systems for oil metering generally comprise a mechanical metering pump that is controlled based on parameters such as the engine speed and/or the position of the gas throttle valve, representing the load of the engine.

These parameters, which are now used to control the metering of oil, have several drawbacks, particularly in the case of air-cooled engines. They do not make it possible, in particular, to ensure good metering regardless of the load and/or the speed of the engine. In particular, metering is unsuitable when the thermal level of the engine varies: when climbing a steep grade or in the event of a failure of the cooling system, for example.

Improvements have therefore already been proposed, such as, for example, in Patent Application EP-A1-0577081. According to this document, it is possible to readjust the amount of oil that is injected based on thresholds stored in a computer memory; it is also possible to vary the length of time between injections.

This technological solution is based primarily on the load and speed values of the engine.

SUMMARY OF THE INVENTION

The present invention is based on a different technical choice. The invention uses monitoring of the oil flow rate based on the temperature of an element of the engine that represents the heat load level of the engine.

This solution makes it possible to achieve reliable and accurate metering which, by ensuring better management, makes it possible to reduce oil consumption considerably, on the order of 30% to 50%.

There may be a very significant risk of deterioration of the engine in the event of defects in the cooling system or major overheating.

To resolve these kinds of problems, the current lubrication systems are designed to guarantee a margin of safety in the event of major overheating of the engine (climbing of a long grade, for example).

These adjustments therefore lead to over-consumption of oil when the engine operates under normal conditions, which are less demanding because the safety margin exists regardless of the operating conditions.

There are currently few systems that are able to actually optimize oil consumption.

Moreover, as emphasized above, the systems with the best performance operate based on parameters such as load and/or engine speed.

Compared to these known techniques, the present invention solves the problems mentioned above, particularly those that are linked to overheating of the engine and excessive oil consumption.

Thus, this invention monitors the oil flow rate for lubricating a two-stroke internal combustion engine that comprises an oil injection circuit for lubrication; said process influences the oil flow rate for lubrication based on a temperature that represents the heat load of the engine.

More specifically, the temperature that represents the heat load is the temperature of an element that constitutes part of said engine.

According to the invention, the engine comprises an ignition element that is equipped with a gasket.

In accordance with this embodiment of the invention, the temperature that represents the heat load of the engine is the temperature of said gasket.

Within the scope of the invention, the temperature that represents the heat load of the engine is the temperature of the ignition element.

In particular, the flow rate of lubricating oil that is injected into the engine is increased when the temperature that represents the heat load of the engine exceeds a predetermined threshold value is increased is increased.

Furthermore, when the oil injection circuit comprises a leak circuit, the lubricating oil flow rate can be influenced by controlling the closing of said leak circuit.

Additionally, the oil flow rate is influenced based on the mechanical load and/or the speed of the engine.

The invention is also a two-stroke internal combustion engine that comprises a circuit for injecting a lubricating oil flow.

Characteristically, the engine comprises:

- a sensor for measuring a temperature that represents the heat load of said engine which feeds to an output a signal that represents said temperature,
- a module for processing said signal, equipped with an input that is connected to the output of the sensor for measuring said temperature and an output which issues a control signal,
- means for adjusting the lubricating oil flow rate, equipped with an input that is connected to the output of the processing module, whereby said adjusting means reacts to the control signal that is shaped by the processing module in such a way that the lubricating oil flow rate is modified based on a temperature that represents the heat load of the engine, measured by said temperature sensor, which is placed on a constituent element of said engine.

According to an embodiment of the invention, the engine is cooled by air and comprises an ignition element that is equipped with a gasket, and the sensor for measuring the temperature that represents the heat load of the engine is then placed on said gasket.

The engine which, according to the invention, comprises an ignition element, has the sensor for measuring the temperature placed on said ignition element.

In addition, the engine according to the invention can comprise a sensor for measuring the load and/or a sensor for measuring the speed of said engine, whereby the output of each of them is connected to an input of said processing module in such a way that the lubricating oil flow rate is also modified based on the load and/or the speed of the engine.

This invention will be better understood, and other elements, details, and characteristics will become clearer from reading the following description, which is given by way of illustration and is in no way limiting, in reference to the accompanying figures:

DESCRIPTION OF THE PREFERRED EMBODIMENTS

Figure 1:
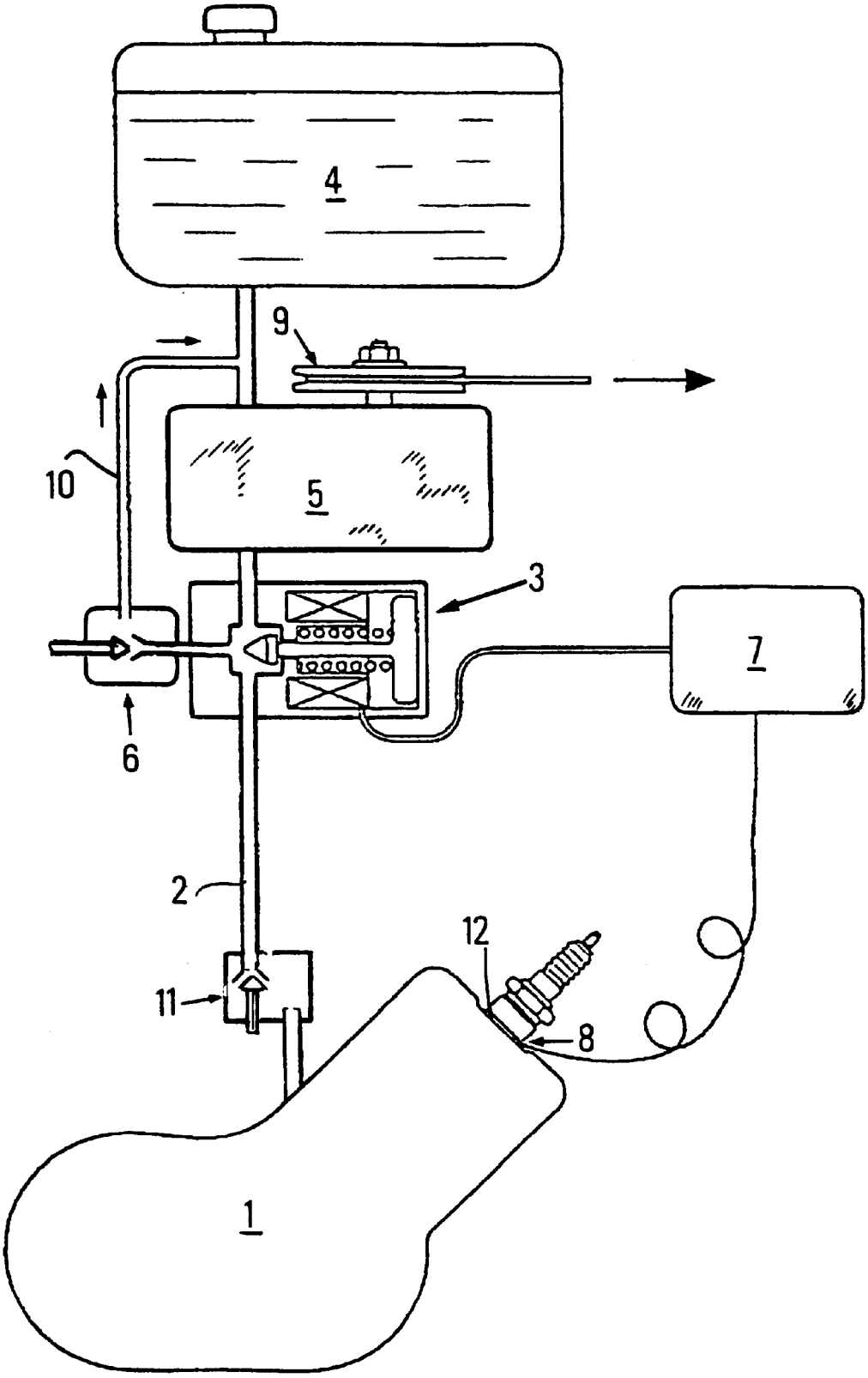
FIG. 1 is a diagram that shows the main elements that are necessary for the implementation of the invention.

FIG. 1 shows a two-stroke engine 1 that is air-cooled, with an oil intake pipe 2. The oil flow rate in this intake is controlled by an element 3 such as a valve that is actuated by a solenoid.

As is done conventionally, an oil reservoir 4 and a pump 5 constitute the supply of oil that is controlled by solenoid 3.

The gasoline intake, not shown in FIG. 1, is provided separately from oil intake 2.

In the system that is presented in FIG. 1, the flow rate of the oil that comes out of pump 5 is divided into two pipes: main supply pipe 2 of the engine and a by-pass pipe 10 where a portion of the oil is recycled upstream from pump 5. It is preferable to insert an anti-return valve 6 into by-pass pipe 10.

A second anti-return valve 11 can also be inserted into main pipe 2, close to the oil intake of the engine, in particular to keep the engine from being supplied with oil when it is stopped. The setting of second valve 11 is then a function of the setting of valve 6.

Main supply pipe 2 and by-pass pipe 10 will be sized to feed a minimum flow rate that is required by the engine when by-pass pipe 10 is open and a maximum flow rate that is required by the engine when by-pass pipe 10 is closed.

In the case of a simple system, solenoid 3 can control the on/off opening of by-pass pipe 10, allowing either a minimum flow rate (normal conditions: by-pass open) or a maximum flow rate (thermal overload conditions; by-pass closed).

In the case of a more sophisticated system, solenoid 3 can move gradually (or according to a variable frequency) and can drive a partial and variable closing system of by-pass pipe 10: for example, with a variable-section needle.

The opening of pipe 10 will thus be done as the heat load of the engine rises, thus making it possible to gradually decrease the oil flow rate in pipe 10.

An electronic calculating unit 7 can advantageously be provided in particular to control solenoid 3. Unit 7 is also connected to an element that represents the heat load of the engine, such as the ignition plug or more specifically a temperature sensor 8 that is placed on spark plug gasket 12.

According to the invention, sensor 8 continuously feeds the temperature of the spark plug gasket to calculating unit 7 which, in turn, and based on particularly the temperature that is provided, controls solenoid 3 in the way that is indicated above.

Oil pump 5 can also be connected to a pulley 9 that is itself connected to the gas throttle valve. This system makes it possible to control the flow rate via the load of the engine. This system is not necessary for the implementation of the invention. This system is an additional element that can make it possible to improve the monitoring of the flow rate via the temperature.

This additional element may prove useful in the event of a failure of the control system that is related to temperature. It can thus be considered a redundant element.

It is possible to envision the control of the oil flow rate by unit 7 being exercised via a temperature sensor that represents the heat load level of the engine. Thus, in the case of a liquid-cooled engine, a coolant temperature sensor can make this control possible. Without exceeding the scope of the invention, a temperature sensor of the casing of the crankcase or of the exhaust can also be provided, in particular in the case of an air-cooled engine.

In all of the cases, the principle is the same: it is to correct and/or to control the oil flow rate based on the temperature of an element that represents the heat load of the engine.

When the heat load increases, the oil flow rate is increased accordingly. A temperature threshold that is recorded in unit 7 determines the moment when the flow rate is to be altered.

Thus, this invention makes possible better management of the oil flow rate, i.e., ultimately a reduction in consumption.

Furthermore, since the implementation of this invention is directly linked to the temperature of the engine, a failure of the cooling system is thus immediately noted and remedied. Actually, as soon as the temperature of the engine increases, the oil flow rate is itself also increased, which can keep the engine from failing.

Furthermore, pilot lamps or other means can be provided to alert the driver as soon as the problem arises.

Figure 2:
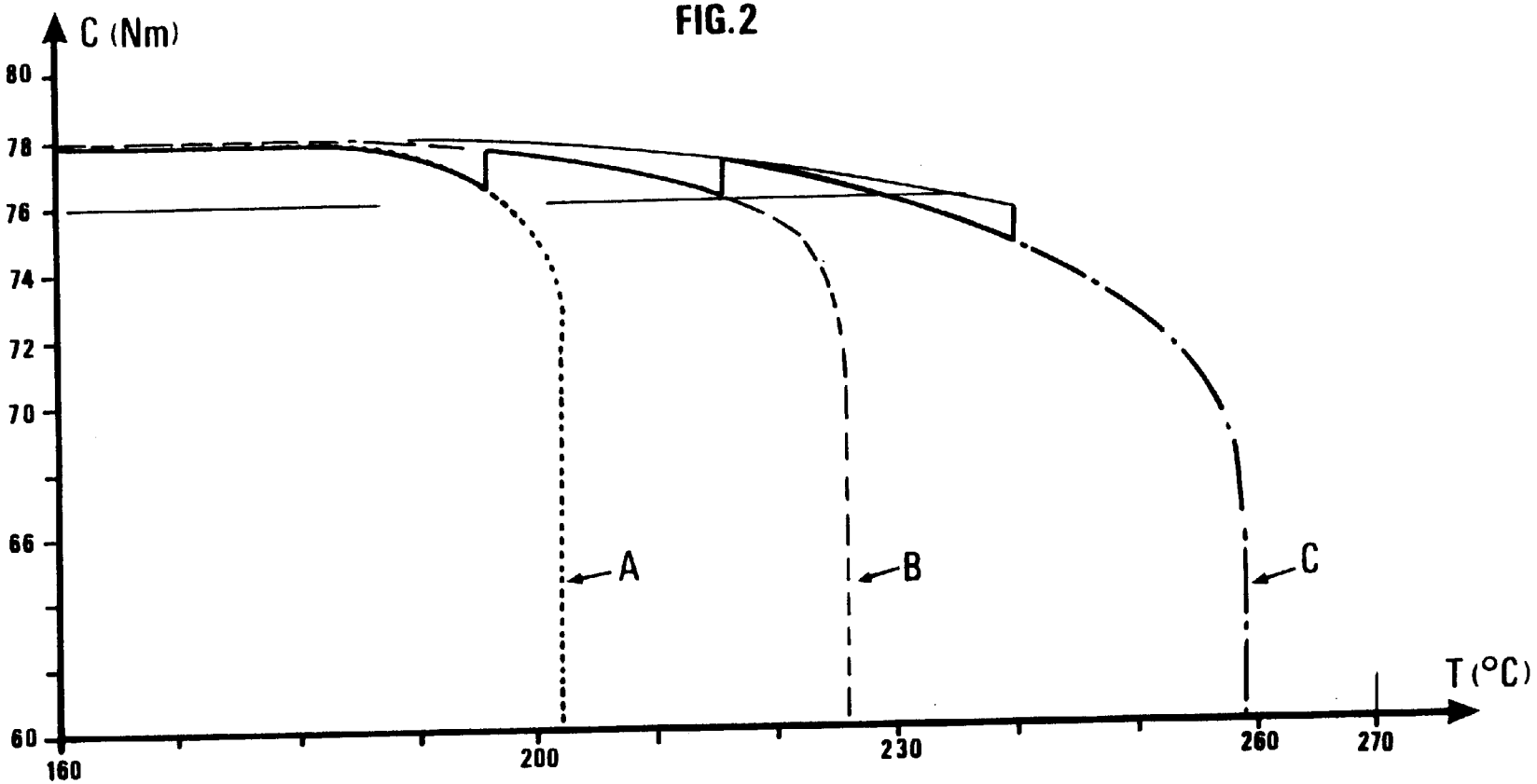
FIG. 2 shows a set of curves of the torque-engine based on the temperature of a characteristic element of the engine.

FIG. 2 makes it possible to better appreciate the problem that underlies the invention.

This figure shows a family of curves (A, B, C) of torque C as a function of temperature T of an element that is characteristic of the temperature of the engine, here the temperature of the spark plug gasket, for various gasoline/lubricating oil mass ratios.

These curves particularly indicate an abrupt drop in torque starting at a certain temperature of the engine, a temperature that is characteristic of locking-up of the engine.

The lubrication of an engine is therefore directly linked to locking-up problems, which arise in the engine as soon as the lubrication is inadequate and a rupture of the oil film occurs. The locking-up problems are also linked to the heat load level of the engine and mainly to the temperature of the piston. Thus, the hotter the engine, the greater the risk of locking up (and therefore of deterioration of the engine). By the same token, the smaller the amount of lubricant that is introduced (high gasoline/lubricant ratio), the more locking-up occurs at low temperature.

Locking-up is characterized by the abrupt drop in torque that produces the complete shutdown of the engine and the deterioration of the piston and the cylinder.

As can be seen in FIG. 2, locking-up occurs around 200° C. for a gasoline/oil ratio of 400:1 (curve A), while it occurs at 260° C. if the gasoline/oil ratio decreases to 100:1 (curve C).

Locking-up occurs around 225° C. when the gasoline/oil ratio is 200:1 (curve B).

This explains the advantage of the invention which, by increasing the oil flow rate when the heat load increases, ensures optimal lubrication regardless of the operating conditions of the engine.

What is claimed is:

1. A process for controlling a flow rate of lubricating oil to a two-stroke internal combustion engine in which oil is delivered to the two-stroke internal combustion engine separated from gasoline comprising:

providing an oil injection circuit which provides lubricating oil to the two-stroke internal combustion engine separated from the gasoline with a flow rate of the lubricating oil provided by the injection circuit being based on a temperature representing a heat load of the engine obtained from a constituent element of the two-stroke internal combustion engine.

2. A process according to claim 1, wherein the engine comprises:

an ignition element having a gasket with a temperature of the gasket being sensed and representing the heat load of two-stroke internal combustion engine.

3. A process according to claim 2, wherein:

the injection circuit comprises a leak circuit, and the flow rate of the lubricating oil flow is obtained by controlling a degree of opening of the leak circuit.

4. A process according to claim 3, wherein:

the flow rate is based in part on at least one of the mechanical load and a speed of the two-stroke engine.

5. A process according to claim 2, wherein:

the flow rate is based in part on at least one of the mechanical load and a speed of the two-stroke engine.

6. A process according to claim 2, wherein:

the lubricating oil flow rate is increased when the sensed temperature representing the heat load of the two-stroke internal combustion engine exceeds a predetermined threshold value.

7. A process according to claim 6, wherein:

the flow rate is based in part on at least one of the mechanical load and a speed of the two-stroke engine.

8. A process according to claim 6, wherein:

the injection circuit comprises a leak circuit, and the flow rate of the lubricating oil flow is obtained by controlling a degree of opening of the leak circuit.

9. A process according to claim 8, wherein:

the flow rate is based in part on at least one of the mechanical load and a speed of the two-stroke engine.

10. A process according to claim 1, wherein the engine comprises:

an ignition element with a temperature of the ignition element being sensed and representing the heat load of two-stroke internal combustion engine.

11. A process according to claim 10, wherein:

the flow rate is based in part on at least one of the mechanical load and a speed of the two-stroke engine.

12. A process according to claim 10, wherein:

the injection circuit comprises a leak circuit, and the flow rate of the lubricating oil flow is obtained by controlling a degree of opening of the leak circuit.

13. A process according to claim 12, wherein:

the flow rate is based in part on at least one of the mechanical load and a speed of the two-stroke engine.

14. A process according to claim 10, wherein:

the lubricating oil flow rate is increased when the sensed temperature representing the heat load of the two-stroke internal combustion engine exceeds a predetermined threshold value.

15. A process according to claim 14, wherein:

the flow rate is based in part on at least one of the mechanical load and a speed of the two-stroke engine.

16. A process according to claim 14, wherein:

the injection circuit comprises a leak circuit, and the flow rate of the lubricating oil flow is obtained by controlling a degree of opening of the leak circuit.

17. A process according to claim 16, wherein:

the flow rate is based in part on at least one of the mechanical load and a speed of the two-stroke engine.

18. A process according to claim 1, wherein:

the lubricating oil flow rate is increased when the sensed temperature representing the heat load of the two-stroke internal combustion engine exceeds a predetermined threshold value.

19. A process according to claim 18, wherein:

the flow rate is based in part on at least one of the mechanical load and a speed of the two-stroke engine.

20. A process according to claim 18, wherein:

the injection circuit comprises a leak circuit, and the flow rate of the lubricating oil flow is obtained by controlling a degree of opening of the leak circuit.

21. A process according to claim 20, wherein:

the flow rate is based in part on at least one of the mechanical load and a speed of the two-stroke engine.

22. A process according to claim 1, wherein:

the injection circuit comprises a leak circuit, and the flow rate of the lubricating oil flow is obtained by controlling a degree of opening of the leak circuit.

23. A process according to claim 22, wherein:

the flow rate is based in part on at least one of the mechanical load and a speed of the two-stroke engine.

24. A process according to claim 1, wherein:

the flow rate is based in part on at least one of the mechanical load and a speed of the two-stroke engine.

25. A two-stroke internal combustion engine in which oil is delivered to the two-stroke internal combustion engine separated from gasoline comprising:

an injection circuit providing lubricating oil with a controlled flow rate to the two-stroke internal combustion engine separated from the gasoline;

a sensor which senses a temperature representing a heat load of the two-stroke internal combustion engine and provides a signal representing the sensed temperature obtained from a constituent of the two-stroke internal combustion engine;

a module, which processes the signal, having an input coupled to the signal provided by the sensor and an output providing a control signal; and a control element, coupled to the output signal, which adjusts the oil flow rate of the injection circuit so that the oil flow rate is controlled based on the sensed temperature.

26. A two-stroke internal combustion engine according to claim 25, comprising:

an ignition element equipped with a gasket with the sensor being associated with the gasket.

27. A two-stroke internal combustion engine according to claim 26 wherein:

the engine is air cooled.

28. A two-stroke engine according to claim 25 comprising:

an ignition element with the sensor being associated with the ignition element.

29. A two-stroke internal combustion engine according to claim 28 wherein:

the engine is air cooled.

30. A two-stroke internal combustion engine according to claim 25 comprising:

at least one sensor which senses at least one of load and speed of the two-stroke internal combustion engine with each sensor being connected to the module which controls oil flow rate based in part on at least one of the sensed load and speed.

31. A two-stroke internal combustion engine according to claim 30 wherein:

the engine is air cooled.

* * * * *